US011817658B2

(12) United States Patent
Khouri et al.

(10) Patent No.: US 11,817,658 B2
(45) Date of Patent: Nov. 14, 2023

(54) ELECTRICAL EQUIPMENT ADAPTED TO DETECT THE PRESENCE OF AN EXTERNAL ANTENNA

(71) Applicant: SAGEMCOM ENERGY & TELECOM SAS, Rueil Malmaison (FR)

(72) Inventors: Rami Khouri, Rueil Malmaison (FR); Alain Tisne, Rueil Malmaison (FR)

(73) Assignee: SAGEMCOM ENERGY & TELECOM SAS, Rueil Malmaison (FR)

( * ) Notice: Subject to any disclaimer, the term of this patent is extended or adjusted under 35 U.S.C. 154(b) by 207 days.

(21) Appl. No.: 17/126,844

(22) Filed: Dec. 18, 2020

(65) Prior Publication Data

US 2021/0194190 A1 Jun. 24, 2021

(30) Foreign Application Priority Data

Dec. 19, 2019 (FR) ..... 1914872

(51) Int. Cl.
*H01Q 1/22* (2006.01)
*H01R 24/52* (2011.01)
*H01Q 1/24* (2006.01)

(52) U.S. Cl.
CPC ..... *H01R 24/52* (2013.01); *H01Q 1/2225* (2013.01); *H01Q 1/243* (2013.01); *H01R 2201/02* (2013.01)

(58) Field of Classification Search
CPC .... H01Q 1/22; H01Q 1/24; H01Q 1/241–243; H01R 24/52; H01R 2201/02
See application file for complete search history.

(56) References Cited

U.S. PATENT DOCUMENTS

2015/0117560 A1* 4/2015 Caimi ..... G01C 21/20 343/893
2018/0287657 A1* 10/2018 Rose ..... H04B 1/0475

FOREIGN PATENT DOCUMENTS

WO WO-2005094154 A2 10/2005
WO WO-2013089553 A1 6/2013
WO WO-2019162432 A1 8/2019

OTHER PUBLICATIONS

Search Report issued in corresponding FR application No. 1914657 with a research completion date of Aug. 31, 2020.

* cited by examiner

*Primary Examiner* — Hasan Islam
(74) *Attorney, Agent, or Firm* — Muncy, Geissler, Olds & Lowe, P.C.

(57) ABSTRACT

Electrical equipment includes an internal antenna, an external connector, a first radio module, a second radio module, an RF link enabling the second radio module to be connected to the external connector, a detector device arranged, when a test signal is transmitted over the external connector via the RF link, to produce a detection signal representative of whether or not the external antenna is connected to the external connector; and control means arranged to control the second radio module so that it generates and transmits the test signal via the RF link, to acquire the detection signal, and depending on the detection signal, to connect or disconnect the first radio module to or from the external connector.

17 Claims, 7 Drawing Sheets

| | C0 | C1 | C2 | C3 | C4 | C5 | C6 | C7 | C8 | C9 | C10 | C11 | C12 | C13 | C14 | C15 | C16 |
|---|---|---|---|---|---|---|---|---|---|---|---|---|---|---|---|---|---|
| | SWR = 1 (P1) | | | SWR = 1 (P2) | | SWR = 2 | | | | SWR = 3 | | | | SWR = infinite | | | |
| | Z2 = 50 Ohms | | | Z1 = 50 Ohms | | Z2 = 25 Ohms | | Z2 = 100 Ohms | | Z2 = 16.5 Ohms | | Z2 = 150 Ohms | | Z2 = 0 Ohm | | Z2 = infinite | |
| Pin(1) | V3 | V4 | | V3 | V4 | V3 | V4 | V3 | V4 | V3 | V4 | V3 | V4 | V3 | V4 | V3 | V4 |
| -10 | 21 | 2 | | 2 | 24 | 21 | 5 | 22 | 5 | 21 | 8 | 27 | 9 | 20 | 18 | 23 | 25 |
| -8 | 31 | 2 | | 2 | 33 | 30 | 7 | 32 | 6 | 30 | 11 | 32 | 11 | 29 | 26 | 33 | 35 |
| -6 | 44 | 2 | | 2 | 47 | 44 | 9 | 45 | 8 | 43 | 16 | 46 | 15 | 41 | 37 | 47 | 49 |
| -4 | 60 | 2 | | 2 | 65 | 61 | 13 | 63 | 11 | 61 | 22 | 64 | 21 | 59 | 53 | 66 | 67 |
| -2 | 85 | 2 | | 2 | 88 | 84 | 18 | 87 | 15 | 84 | 31 | 87 | 30 | 81 | 74 | 90 | 92 |
| 0 | 114 | 2 | | 2 | 118 | 112 | 26 | 117 | 21 | 111 | 43 | 116 | 42 | 107 | 97 | 124 | 125 |
| 2 | 152 | 2 | | 2 | 157 | 150 | 36 | 156 | 30 | 149 | 59 | 157 | 58 | 142 | 131 | 165 | 165 |
| 4 | 201 | 2 | | 2 | 207 | 198 | 50 | 205 | 42 | 199 | 81 | 209 | 78 | 189 | 173 | 218 | 217 |
| 6 | 266 | 2 | | 2 | 274 | 266 | 72 | 270 | 57 | 266 | 112 | 271 | 104 | 258 | 238 | 276 | 273 |
| 8 | 346 | 2 | | 2 | 355 | 347 | 99 | 347 | 78 | 348 | 154 | 354 | 140 | 337 | 310 | 359 | 353 |
| 10 | 443 | 2 | | 2 | 452 | 441 | 131 | 449 | 101 | 444 | 200 | 452 | 180 | 438 | 404 | 460 | 450 |

ELECTRICAL EQUIPMENT ADAPTED TO DETECT THE PRESENCE OF AN EXTERNAL ANTENNA

The invention relates to the field of electrical equipment including a radio module capable of operating with an internal antenna or an external antenna if such an external antenna is connected to the electrical equipment.

BACKGROUND OF THE INVENTION

Certain kinds of electrical equipment, and in particular certain smart meters and certain gateways, include a radio module capable of operating either with an internal antenna incorporated in the electrical equipment, or else with an external antenna added to the electrical equipment and connected to an external connector of the electrical equipment that is provided for this purpose.

By way of example, the radio module may be a cellular radio module, and the external connector may be a coaxial connector.

Using the external antenna serves to improve the reception and transmission of data by the electrical equipment. Thus, and by way of example, when an electricity meter is to be installed in a location having poor cellular network coverage, e.g. in a cellar, an external antenna is connected to the electricity meter in order to enable it to transmit uplink data and to receive downlink data more effectively.

It is therefore appropriate to detect whether an external antenna is connected to the external connector of the electrical equipment so as to be able to connect the radio module to the external antenna when it is present.

In the prior art, the following solutions are known for detecting the presence of an external antenna connected to an external connector of coaxial connector type.

A "mechanical" solution can be seen in FIG. 1. A piece of electrical equipment 1 has a cellular radio module 2, an internal antenna 3, and a coaxial connector (e.g. a subminiature version A (SMA) connector) that incorporates a switch 5. It is the coaxial connector 4 that acts mechanically to detect the connection of an external antenna 6 or of a cable to which the external antenna 6 is connected.

In an "optical" solution, an optical link arranged downstream from the coaxial connector detects the obstruction caused by inserting the external antenna or a cable to which the external antenna is connected.

In an "electrical" solution, a direct current (DC) signal is interrupted by the presence of an external antenna fitted with a DC resistor.

In a "radio transmission" solution, transmission by the radio module is activated, and reflection of the transmitted signal is measured.

In a "radio reception" solution, a comparison is made between the powers of signals received on the two channels of the radio module, i.e. the channel including the internal antenna and the channel including the coaxial connector.

Those detection techniques raise the following problems.

The "mechanical" solution requires special coaxial connectors, which are bulky, expensive (about three times the price of a conventional coaxial connector), and difficult to incorporate on a printed circuit. The main functional drawback of that solution lies in the appearance of mechanical chatter in the event of the external antenna or the cable connected to the coaxial connector being loose. Furthermore, when in the presence of a coaxial cable, it is not possible to detect whether an antenna is present at the end of the coaxial cable. In spite of the above-mentioned lack of robustness, that method remains the simplest, and it is in very widespread use when the radio module is of the cellular type.

The "optical" solution is not robust because elements can obstruct the optical link (e.g. dust).

As mentioned above, the "electrical" solution requires the use of external antennas that are special in that they are equipped with a DC resistor, thereby greatly limiting the external antennas that can be selected.

The "radio transmission" solution constitutes the technique that is the most reliable at present. Nevertheless, that solution is not applicable with a cellular radio module. Specifically, transmitting a continuous wave signal is permitted only in a "test" mode, which cannot be set up in the field. Waiting for a signal with standard signaling to be transmitted (i.e. a signal complying with the third generation partnership project (3GPP) protocol and with radio standards) can take a long time (up to 1 hour if it is necessary to scan several technologies such as the second, third, and fourth generation (2G, 3G, and 4G) technologies, for example).

The "radio reception" solution is not very reliable since it depends greatly on external conditions (network quality, transient noise, immediate environment of the electrical equipment, etc.).

OBJECT OF THE INVENTION

An object of the invention is to provide a solution making it possible to detect that an external antenna is connected to electrical equipment as described above, said solution not presenting the above-mentioned drawbacks.

SUMMARY OF THE INVENTION

In order to achieve this object, there is provided electrical equipment comprising:

- an internal antenna;
- an external connector to which an antenna external to the electrical equipment can be connected;
- a first radio module;
- a second radio module;
- a radiofrequency (RF) link enabling the second radio module to be connected to the external connector;
- a detector device arranged, when a test signal is transmitted over the external connector via the RF link, to produce a detection signal representative of whether or not the external antenna is connected to the external connector;
- control means arranged to control the second radio module so that it generates and transmits the test signal via the RF link, to acquire the detection signal, and depending on the detection signal, to connect the first radio module to the external connector if the external antenna is connected to the external connector, or else to connect the first radio module to the internal antenna if the external antenna is not connected to the external connector.

Thus, in the electrical equipment of the invention, an additional RF link is added serving to connect the second radio module to the external connector, and advantage is taken of the presence of the second radio module to detect whether an external antenna, for connecting to the first radio module, is or is not connected to the external connector.

The solution of the invention is very advantageous.

Specifically, the solution of the invention is performed using a conventional external connector and therefore does not present the problems associated with the special connector of the above-described "mechanical" solution. Furthermore, the detection performed by the test signal and the detection signal serves, when a cable is connected to the external connector, to detect whether an external antenna is or is not connected to the other end of the cable.

The solution of the invention is robust and cannot be disturbed by dust.

The solution of the invention can be performed regardless of the type of external antenna that is used.

When the first radio module is a cellular radio module and when the second radio module is a radio module of the industrial, scientific, and medical (ISM) type, the solution of the invention does not present the difficulties involved in performing the "radio transmission" solution. Specifically, it is possible to transmit a test signal from the ISM radio module at any time, naturally providing that ISM standards are complied with.

Finally, the solution of the invention is performed entirely within the electrical equipment and it is not disturbed by conditions outside it.

There is also provided electrical equipment as described above, wherein the RF link is a conducted link.

There is also provided electrical equipment as described above, wherein the RF link is a radiated link, the detector device including a link antenna connected by the RF link to a communication antenna of the second radio module.

There is also provided electrical equipment as described above, including a main RF transmission line comprising a main RF track connected to the external connector, the detector device comprising a detector RF transmission line comprising a detector RF track coupled to the main RF track, and detector components connected to the detector RF track.

There is also provided electrical equipment as described above, wherein the detector components comprise first detector components connected to a first end of the detector RF track and arranged to produce a first voltage representative of a forward power resulting directly from transmission of the test signal, and second detector components connected to a second end of the detector RF track and arranged to produce a second voltage representative of a reflected power resulting from reflection of the test signal, the detection signal being obtained from the first voltage and from the second voltage.

There is also provided electrical equipment as described above, wherein the first and second detector components comprise respective first and second voltage boost circuits followed by respective first and second peak detector diodes.

There is also provided electrical equipment as described above, wherein the main RF transmission line is a wide band transmission line while the detector RF transmission line is a selective transmission line tuned to a test frequency of the test signal.

There is also provided electrical equipment as described above and including a switch device, the control means being arranged to control the switch device so as to connect or disconnect the second radio module selectively to or from the external connector, and so as to connect the first radio module selectively to the internal antenna or to the external connector.

There is also provided electrical equipment as described above, wherein the switch device comprises a first double-throw switch and a second double-throw switch, the first double-throw switch having a first input connected to an output of the first radio module and a second input connected to an output of the second radio module via the RF link, and the second double-throw switch having an input connected to an output of the first double-throw switch, a first output connected to the internal antenna, and a second output connected to the external connector.

There is also provided electrical equipment as described above, wherein a test frequency of the test signal is included in a frequency band in which the first radio module operates.

There is also provided electrical equipment as described above, wherein the test signal is encoded so as to avoid an interfering signal at the test frequency disturbing the detector device.

There is also provided electrical equipment as described above, wherein the first radio module is a cellular radio module and wherein the second radio module is an ISM radio module.

There is also provided electrical equipment as described above, the electrical equipment being a meter.

There is also provided electrical equipment as described above, the electrical equipment being a gateway.

There is also provided a method of detecting and connecting an external antenna, the method being performed in electrical equipment as described above and comprising the steps of:

controlling the second radio module so that it generates and transmits the test signal over the external connector via the RF link;

acquiring the detection signal;

deducing from the detection signal whether or not the external antenna is connected to the external connector; and if the external antenna is connected to the external connector, connecting the first radio module to the connector; or else connecting the first radio module to the internal antenna.

There is also provided a computer program including instructions that enable the above-described electrical equipment to execute the steps of the above-described method of detecting and connecting an external antenna.

There is also provided a computer readable storage medium, having stored thereon the computer program as described above.

The invention can be better understood in the light of the following description of particular, nonlimiting embodiments of the invention.

BRIEF DESCRIPTION OF THE DRAWINGS

Reference is made to the accompanying drawings, in which.

DETAILED DESCRIPTION OF THE INVENTION

Figure 1:
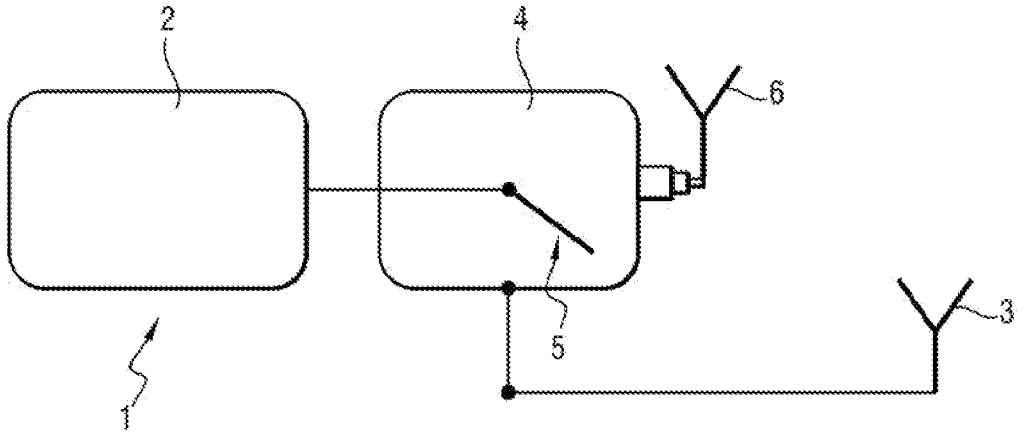
FIG. 1 shows a prior art "mechanical" solution for detecting the presence of an external antenna.
Figure 2:
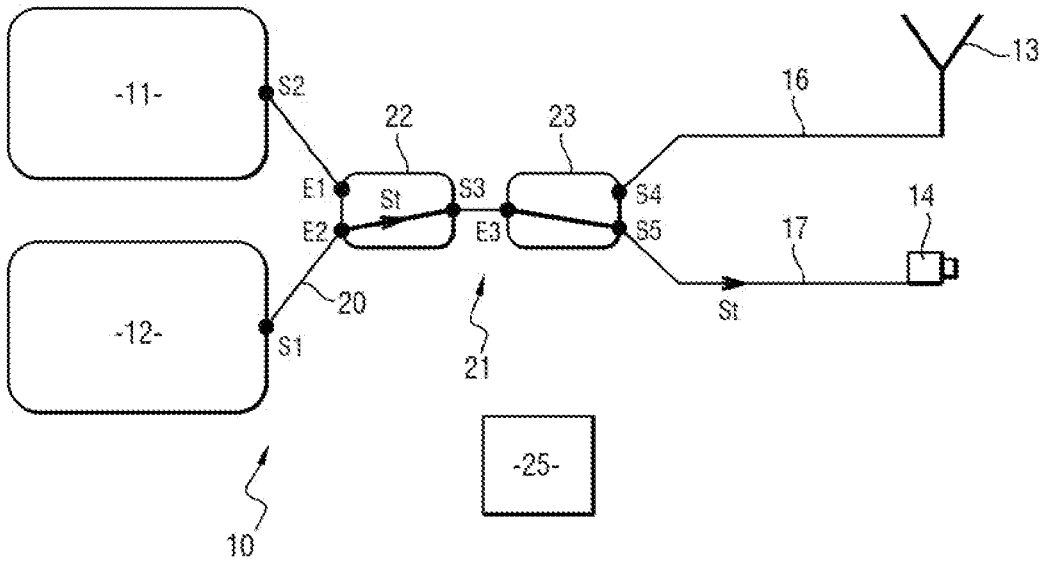
FIG. 2 shows electrical equipment in a first embodiment of the invention.
Figure 3:
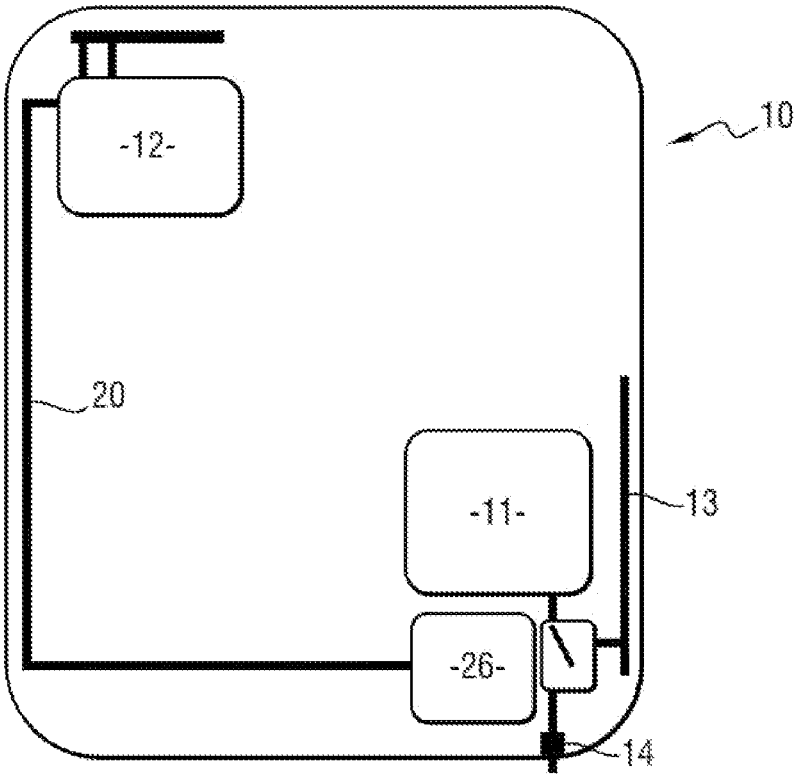
FIG. 3 also shows electrical equipment in the first embodiment of the invention.

With reference to FIGS. 2 to 6, in this example electrical equipment in a first embodiment of the invention is an electricity meter 10 comprising a housing incorporating a first radio module 11 and a second radio module 12.

In this example, the term "radio module" is used to mean a module arranged to perform communication (transmission and/or reception) by radio.

The first radio module 11 is a cellular radio module capable of communicating by using some or all of the following standards: 2G, 3G, 4G, Cat-M, NB-IoT, etc.

The second radio module 12 is an ISM radio module. In this example, the second radio module 12 operates at an ISM frequency of 868.3 megahertz (MHz).

The meter 10 has an internal antenna 13 situated inside the housing, and an external connector, specifically a coaxial connector 14, that enables an external antenna to be connected to the meter 10.

It should be observed that the external antenna may be connected directly to the coaxial connector 14, or else it may be connected via a cable that then has a first end to which the external antenna is connected and a second end that is connected to the coaxial connector 14.

The meter 10 includes a first main RF transmission line 16 that serves to connect the first radio module 11 to the internal antenna 13, and a second main RF transmission line 17 that serves to connect the second radio module 12 to the coaxial connector 14.

Figure 4:
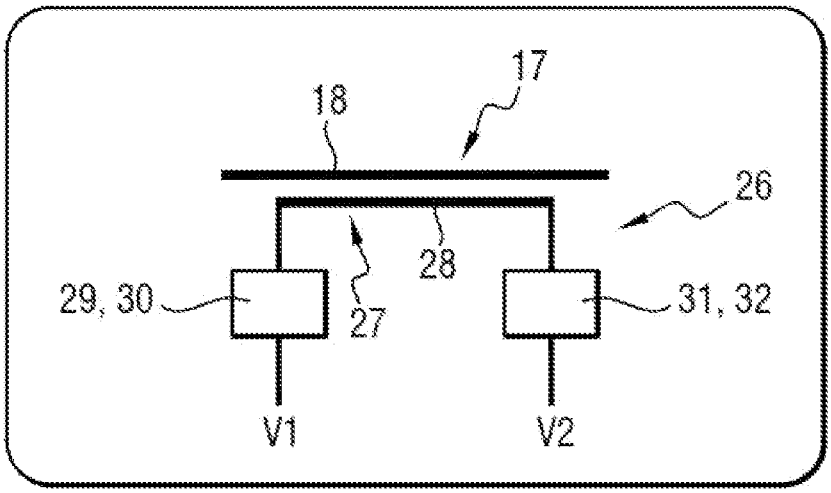
FIG. 4 shows a detector device in simplified manner.
Figure 5:
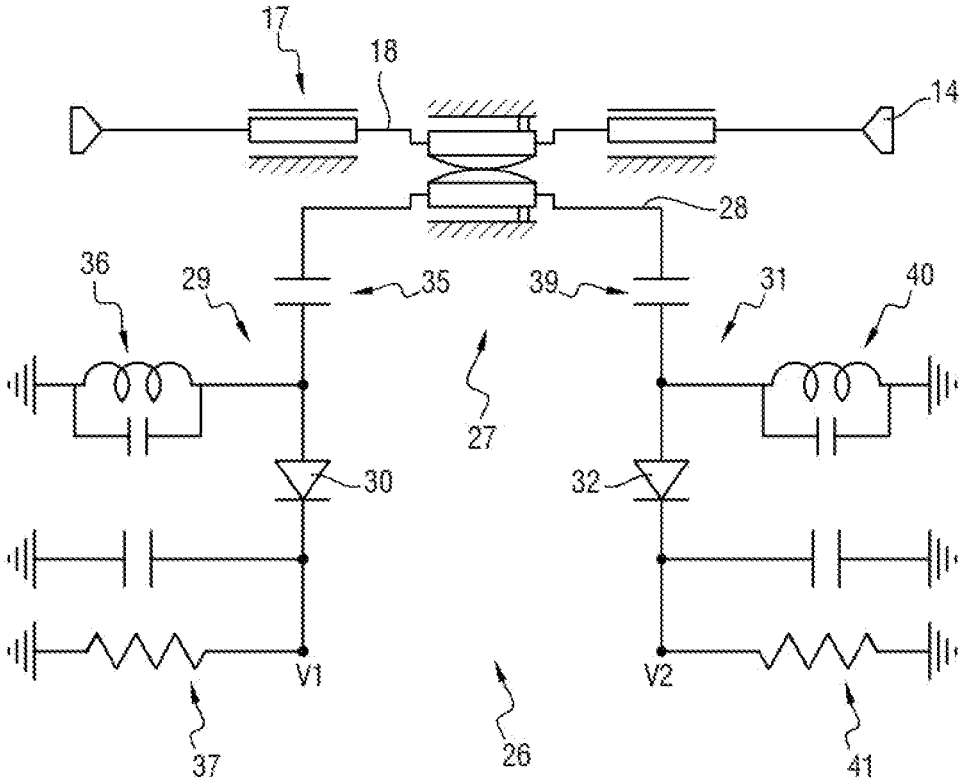
FIG. 5 shows the detector device more accurately.
Figure 6:
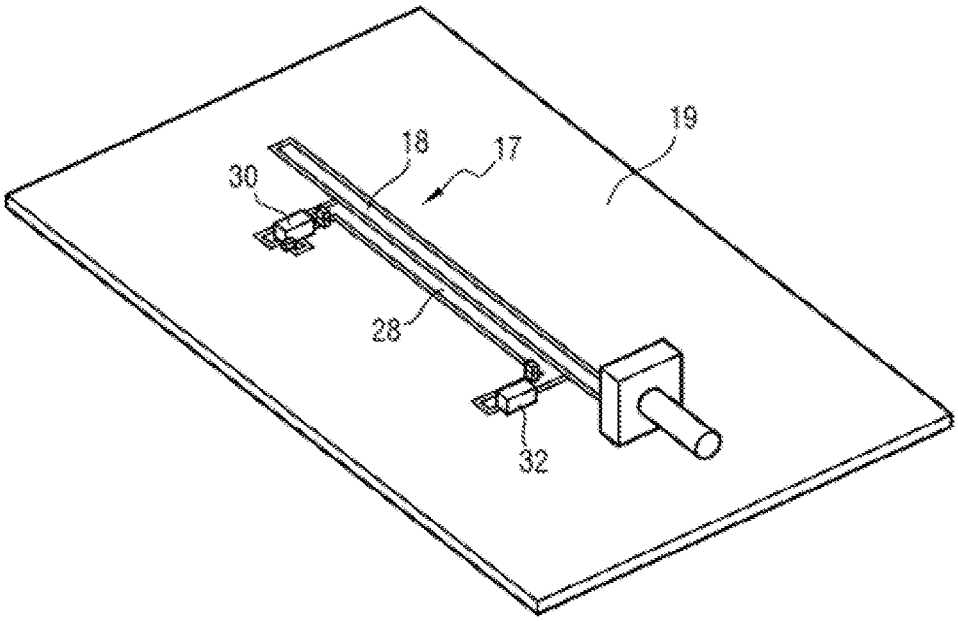
FIG. 6 is a perspective view of a portion of an electrical circuit card including the detector device and a coaxial connector.

The second main RF transmission line 17 can be seen more clearly in FIGS. 4 to 6. It can be seen that the second main RF transmission line 17 has a main RF track 18. The main RF track 18 is a copper track formed on a face of a portion of a circuit card. The remainder of the face of the portion of the circuit card is covered for the most part by a copper surface 19 that forms a ground plane, such that the main RF track 18 extends in said ground plane 19 while being insulated therefrom by narrow strips of substrate that are not covered in copper.

The meter 10 also includes an RF link 20 that enables an output S1 of the second radio module 12 to be connected to the coaxial connector 14. In this example, the RF link 20 is a conducted link that comprises an RF track or an RF cable.

The meter 10 also has a switch device 21 that comprises a first double-throw switch 22 and a second double-throw switch 23. The first double-throw switch 22 has a first input E1 connected to an output S2 of the first radio module 11 and a second input E2 connected to the output S1 of the second radio module 12 via the RF link 20, and an output S3. The second double-throw switch 23 has an input E3 connected to the output S3 of the first double-throw switch 22, a first output S4 connected to the internal antenna 13 via the first main RF transmission line 16, and a second output S5 connected to the coaxial connector 14 via the second main RF transmission line 17.

The meter 10 further includes control means that in this example comprise a control component 25 adapted to execute instructions of a program for performing the steps of the method described below for detecting and connecting an external antenna. By way of example, the control component 25 is a microcontroller, a processor, or indeed a programmable logic circuit such as a field programmable gate array (FPGA) or an application specific integrated circuit (ASIC).

The control component 25 is connected to the first double-throw switch 22 and to the second double-throw switch 23 and it is arranged to control them, i.e. to connect the first input E1 or the second input E2 of the first double-throw switch 22 selectively to the output S3 of the first double-throw switch 22, and to connect the input E3 of the second double-throw switch 23 to the first output S4 or to the second output S5 of the second double-throw switch 23.

The meter 10 also has a detector device 26 that can be seen more clearly in FIGS. 4 to 6. The detector device 26 comprises a coupler-detector circuit including a detector RF transmission line 27 comprising a detector RF track 28 coupled to the main RF track 18, and detector components connected to the detector RF track 28.

The detector components comprise first detector components connected to a first end of the detector RF track 28, and second detector components connected to a second end of the detector RF track 28.

The first detector components comprise a first voltage boost circuit 29 followed by a first peak detector diode 30 and a resistor-capacitor (RC) network 37. The second detector components comprise a second voltage boost circuit 31 followed by a second peak detector diode 32 and an RC network 41.

The first voltage boost circuit 29 comprises a first capacitor 35 connected to the first end of the detector RF track 28 and a first inductor-capacitor (LC) circuit 36 to which the first peak detector diode 30 is connected. Likewise, the second voltage boost circuit 31 comprises a second capacitor 39 connected to the second end of the detector RF track 28 and a second LC circuit 40 to which the second peak detector diode 32 is connected.

Because of the presence of the first detector components and of the second detector components, the detector RF transmission line 27 is a selective transmission line tuned to the above-mentioned ISM frequency (868.3 MHz). The coupler-rectifier is thus likewise tuned to the ISM frequency.

In contrast, the second main RF transmission line 17 is a wide band transmission line.

Figure 7:
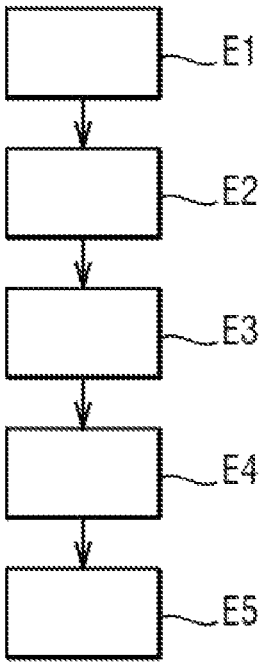
FIG. 7 shows steps of a detection and connection method.

The method performed in the meter 10 for detecting and connecting an external antenna is described below in detail. The sequence of the main steps of the method can be seen in FIG. 7.

By default, the first double-throw switch 22 and the second double-throw switch 23 are in a configuration such that the output S1 of the second radio module 12 is connected to the coaxial connector 14 (via the RF link 20 and the second main RF transmission line 17; step E1). The second input E2 of the first double-throw switch 22 is thus connected to the output S3 of the first double-throw switch 22 and the second output S5 of the second double-throw switch 23 is connected to the input E3 of the second double-throw switch 23, and thus to the second input E2 of the first double-throw switch 22.

The control component 25 then controls the second radio module 12 so that it generates and transmits a test signal St over the coaxial connector 14 via the RF link 20 (step E2).

The test frequency of the test signal St is the ISM frequency of 868.3 MHz. It should be observed that it is preferable for the test frequency of the test signal St to be included in the frequency band in which the first radio module 11 operates, as in this example.

The detector device 26 then produces a detection signal representative of whether or not the external antenna is connected to the coaxial connector 14 (step E3). The detection signal is acquired by the control component 25.

In this example, the detection signal is obtained from a first voltage V1 produced across the terminals of the RC network 37 and from a second voltage V2 produced across the terminals of the RC network 41. Specifically, in this example, the detection signal is equal to: V2−V1.

The control component 25 acquires, digitizes, and analyzes the first voltage V1 and the second voltage V2.

The first voltage V1 is representative of a forward power, obtained from the first end of the detector RF track 28, and resulting from the forward transmission of the test signal St.

The second voltage V2 is representative of a reflected power, obtained from the second end of the detector RF track 28, and resulting from the test signal St being reflected, as a function of the configuration, either from the coaxial connector 14 on its own, or else from the coaxial connector 14 and the external antenna (and also the cable, if any, connected to the coaxial connector 14 and to the external antenna).

Figure 8:
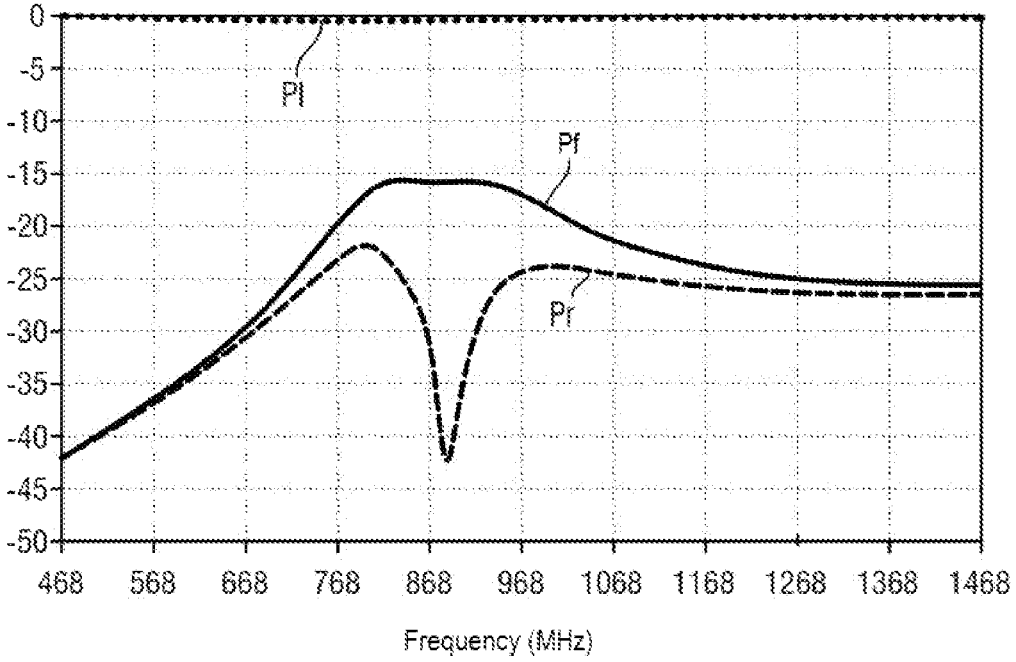
FIG. 8 is a graph plotting a forward power curve, a reflected power curve, and a curve of power measured on a main RF track, the curves being obtained while an external antenna is connected.
Figure 9:
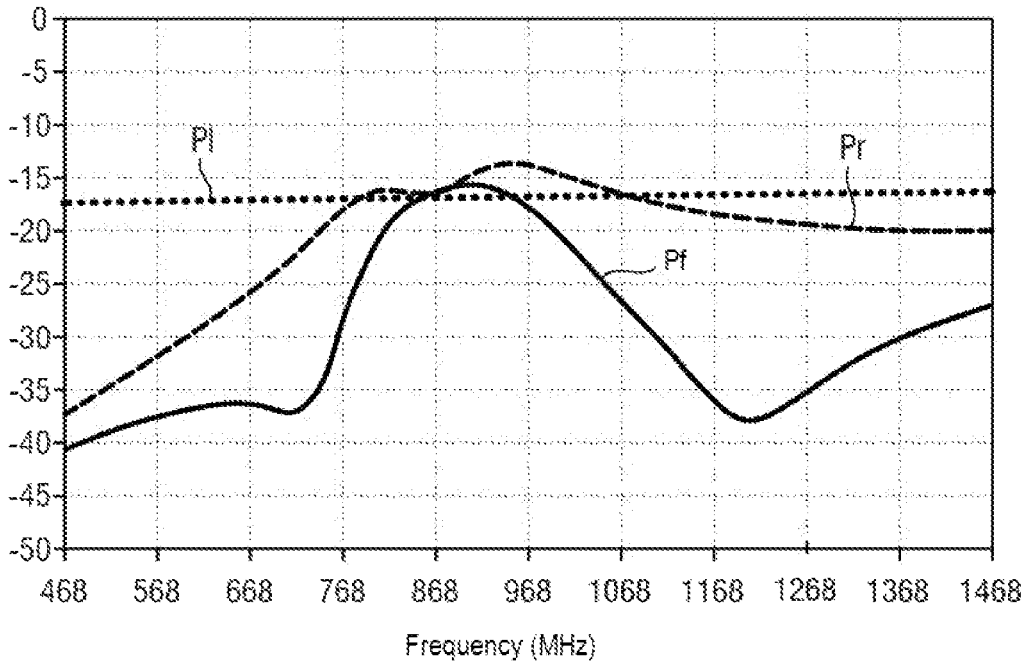
FIG. 9 is a graph similar to the graph of FIG. 8, the curves being obtained while the external antenna is not connected.
Figure 10:
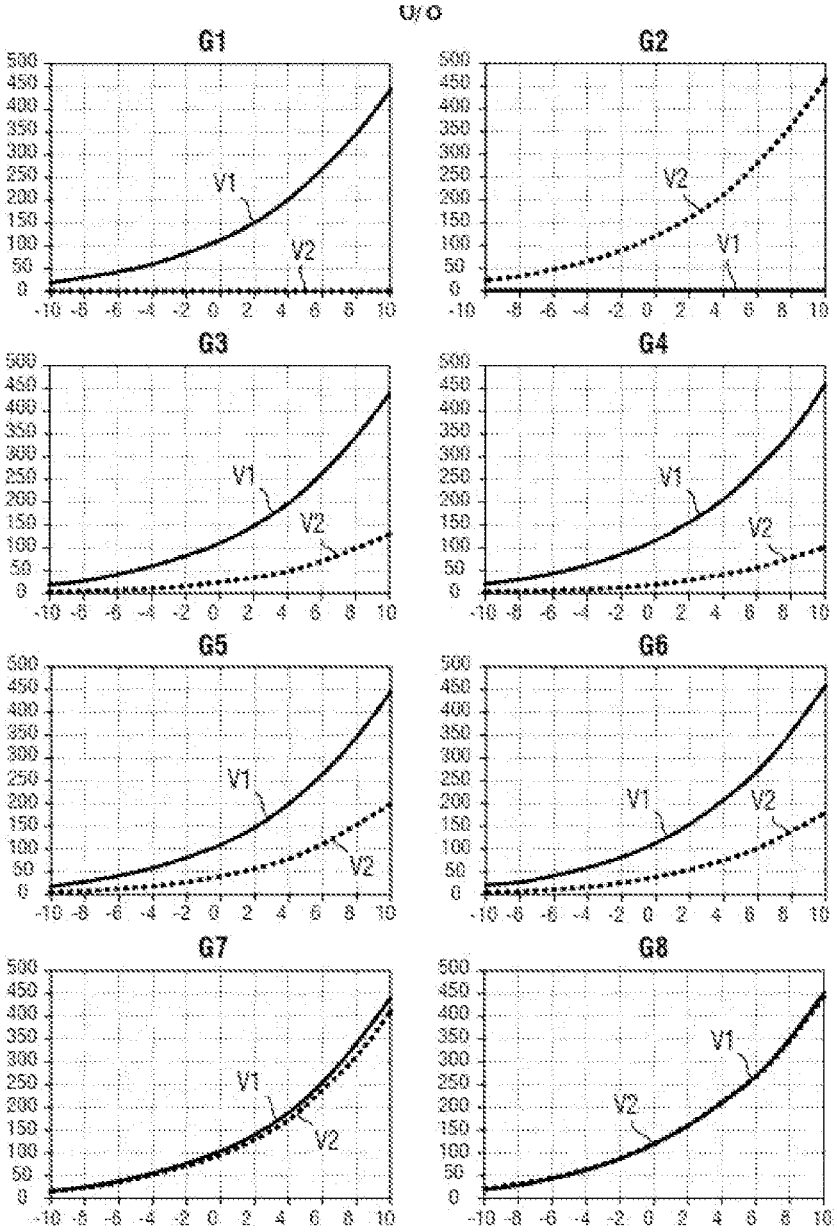
FIG. 10 comprises graphs, each comprising a first voltage curve and a second voltage curve, the curves being obtained by simulation with different standing wave ratios (SWRs) and with different impedances.

In FIG. 8, it can be seen that, when the external antenna, which forms a tuned load, is connected, the forward power Pf at the test frequency is much greater than the reflected power Pr. In comparison, in FIG. 9 it can be seen that, when the external antenna is not connected, the forward power Pf and the reflected power Pr are very close to each other. In the graphs of FIGS. 8 and 9, the curve Pl corresponds to the power detected on the main RF track 18.

The difference between the second voltage V2 and the first voltage V1 thus forms a detection signal that is representative of whether or not the external antenna is connected to the coaxial connector 14.

The control component 25 compares the detection signal, i.e. the difference between the second voltage V2 and the first voltage V1, with a predetermined detection threshold Vth.

If the following applies:

$$V2-V1<Vth$$

then the control component 25 detects that the external antenna is not connected.

In contrast, if the following applies:

$$V2-V1\geq Vth$$

then the control component 25 detects that the external antenna is connected (step E4).

If the control component 25 detects that the external antenna is not connected, then the control component 25 controls the first double-throw switch 22 and the second double-throw switch 23 so that the output S2 of the first radio module 11 is connected to the internal antenna 13.

If the control component 25 detects that the external antenna is connected, then the control component 25 controls the first double-throw switch 22 and the second double-throw switch 23 so that the output S2 of the first radio module 11 is connected to the coaxial connector 14 and thus to the external antenna (step E5).

It should be observed that the value of the predetermined detection threshold Vth is determined from measurements taken in a plurality of configurations, each corresponding to a possible termination for the coaxial connector 14.

In a first configuration, this gives:

SWR=1 that corresponds to the standing wave ratio for a perfectly matched external antenna (50 ohm (Ω) load).

In a second configuration, this gives:

SWR=2 that corresponds to the SWR of a well-matched external antenna (90% of the signal is passed from the coaxial connector 14 to the external antenna).

In a third configuration, this gives:

SWR=3 that corresponds to an external antenna of poorer quality (this situation is possible in use, since most multi-band external antennas have quality of this order).

In a fourth configuration, this gives:

SWR is infinite that corresponds to an open circuit, and thus to the absence of an external antenna. It should be observed that this applies also when a cable has its second end connected to the coaxial connector 14, but has no external antenna connected to its first end.

The predetermined detection threshold is optimized as a function of the type of load, in such a manner that even an ordinary external antenna (presenting an SWR of 3) can be detected easily.

Advantageously, the test signal St is encoded by simple coding, e.g. of on-off keying (OOK) type.

This avoids an interfering signal at the test frequency disturbing the detector device 26, and in particular this makes it impossible to take a decision on the basis of the received interfering signal.

This makes discrimination between the two states even more robust.

There follows a description of the results of simulations performed on the detector device 26 for different SWR values and using different impedance values.

The graph G1 corresponds to the SWR being equal to 1 and the impedance at the second end (connected to the coaxial connector 14) of the main RF track 18 is equal to 50Ω. The graph G2 corresponds to the SWR being equal to 1 and the impedance at the first end (connected to the switch device 21) of the main RF track 18 is equal to 50Ω.

Figures 11, 12:
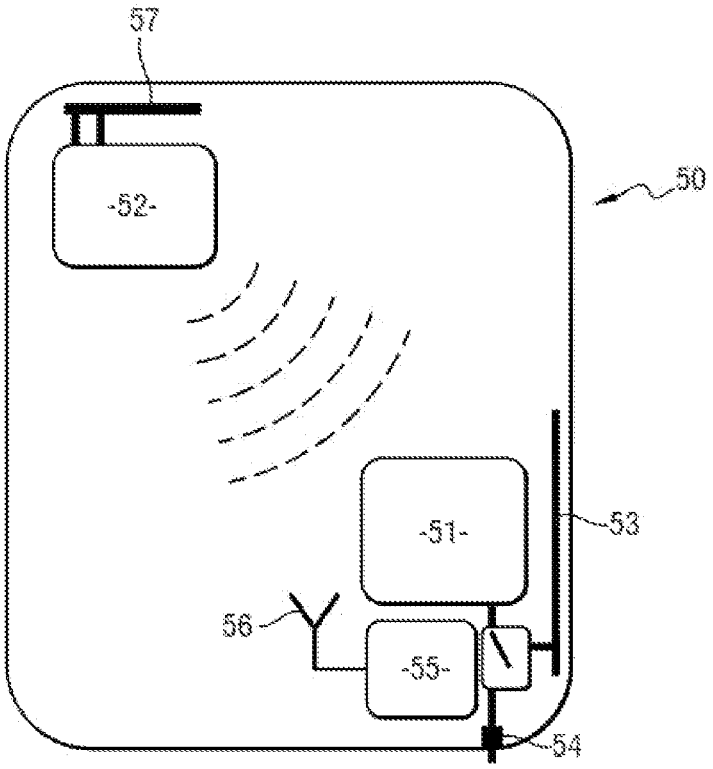
FIG. 11 is a table of values used for obtaining the curves of FIG. 10.
FIG. 12 shows electrical equipment in a second embodiment of the invention.

On the graph G1, the curve for the first voltage V1 is obtained from the values in column C1 in the table in FIG. 11. The curve for the second voltage V2 is obtained from the values in column C2 in the table of FIG. 11.

On the graph G2, the curve for the first voltage V1 is obtained from the values in column C3 in the table in FIG. 11. The curve for the second voltage V2 is obtained from the values in column C4 in the table of FIG. 11.

Column C0 contains the values (in decibels (dB)) of the power detected on the second main RF transmission line 17. These values are plotted along the abscissa axis in the various graphs.

The graph G3 corresponds to the SWR being equal to 2 and the impedance at the second end of the main RF track 18 being equal to 25Ω. The graph G4 corresponds to the SWR being equal to 2 and the impedance at the second end of the main RF track 18 being equal to 100Ω.

On the graph G3, the curve for the first voltage V1 is obtained from the values in column C5 in the table in FIG. 11. The curve for the second voltage V2 is obtained from the values in column C6 in the table of FIG. 11.

On the graph G4, the curve for the first voltage V1 is obtained from the values in column C7 in the table in FIG. 11. The curve for the second voltage V2 is obtained from the values in column C8 in the table of FIG. 11.

The graph G5 corresponds to the SWR being equal to 3 and the impedance at the second end of the main RF track 18 being equal to 16.5Ω. The graph G6 corresponds to the SWR being equal to 3 and the impedance at the second end of the main RF track 18 being equal to 150Ω.

On the graph G5, the curve for the first voltage V1 is obtained from the values in column C9 in the table in FIG. 11. The curve for the second voltage V2 is obtained from the values in column C10 in the table of FIG. 11.

On the graph G6, the curve for the first voltage V1 is obtained from the values in column C11 in the table in FIG. 11. The curve for the second voltage V2 is obtained from the values in column C12 in the table of FIG. 11.

The graph G7 corresponds to the SWR being infinite and the impedance at the second end of the main RF track 18 being equal to 0Ω. The graph G8 corresponds to the SWR being infinite and the impedance at the second end of the main RF track 18 being infinite.

On the graph G7, the curve for the first voltage V1 is obtained from the values in column C13 in the table in FIG. 11. The curve for the second voltage V2 is obtained from the values in column C14 in the table of FIG. 11.

On the graph G8, the curve for the first voltage V1 is obtained from the values in column C15 in the table in FIG. 11. The curve for the second voltage V2 is obtained from the values in column C16 in the table of FIG. 11.

It can be seen that the detectable difference between the first voltage V1 and the second voltage V2 is at least 6 dB (for a mediocre external antenna) and is 9 dB for a well-matched external antenna. This difference is much greater than the situation where the external antenna is absent, which leaves a comfortable margin for defining a predetermined detection threshold Vth that is robust. Detecting the presence or the absence of an external antenna is thus both robust and reliable.

With reference to FIG. 12, electrical equipment in a second embodiment is once again an electricity meter 50.

The electricity meter 50 has a first radio module 51 (which is cellular), a second radio module 52 (which is ISM), an internal antenna 53, and a coaxial connector 54.

In this embodiment, the RF link enabling the second radio module 52 to be connected to the coaxial connector 54 is a radiated link. The detector device 55 has a link antenna 56 connected by the RF link to a communication antenna 57 of the second radio module 52. The communication antenna 57 is tuned to the test frequency, which is the ISM frequency of the second radio module 52.

Naturally, the invention is not limited to the embodiments described, but covers any variant coming within the ambit of the invention as defined by the claims.

The electrical equipment in which the invention is performed need not necessarily be an electricity meter, but could be any other type of meter, and could even be any electrical equipment other than a meter, e.g. a gateway.

In the description above, it is stated that the control component controls the second radio module so that it generates and transmits the test signal via the RF link, acquires the detection signal, and depending on the detection signal, controls the switch device. Naturally, these operations could be performed by a plurality of distinct components.

The first radio module need not necessarily be a cellular radio module, and the second radio module need not necessarily be an ISM module.

The invention claimed is:

1. Electrical equipment, comprising:

an internal antenna;

an external connector to which an external antenna is connectable;

a first radio module;

a second radio module;

an RF link enabling the second radio module to be connected to the external connector;

a detector device arranged, when a test signal is transmitted over the external connector via the RF link, to produce a detection signal representative of whether or not the external antenna is connected to the external connector;

control means arranged to control the second radio module so that it generates and transmits the test signal via the RF link, to acquire the detection signal, and depending on the detection signal, to connect the first radio module to the external connector if the external antenna is connected to the external connector, or else to connect the first radio module to the internal antenna if the external antenna is not connected to the external connector.

2. The electrical equipment according to claim 1, wherein the RF link is a conducted link.

3. The electrical equipment according to claim 1, wherein the RF link is a radiated link, the detector device including a link antenna connected by the RF link to a communication antenna of the second radio module.

4. The electrical equipment according to claim 1, including a main RF transmission line comprising a main RF track connected to the external connector, the detector device comprising a detector RF transmission line comprising a detector RF track coupled to the main RF track, and detector components connected to the detector RF track.

5. The electrical equipment according to claim 4, wherein the detector components comprise first detector components connected to a first end of the detector RF track and arranged to produce a first voltage representative of a forward power resulting directly from transmission of the test signal, and second detector components connected to a second end of the detector RF track and arranged to produce a second voltage representative of a reflected power resulting from reflection of the test signal, the detection signal being obtained from the first voltage and from the second voltage.

6. The electrical equipment according to claim 5, wherein the first and second detector components comprise respective first and second voltage boost circuits followed by respective first and second peak detector diodes.

7. The electrical equipment according to claim 4, wherein the main RF transmission line is a wide band transmission line while the detector RF transmission line is a selective transmission line tuned to a test frequency of the test signal.

8. The electrical equipment according to claim 1 and including a switch device, the control means being arranged to control the switch device so as to connect or disconnect the second radio module selectively to or from the external connector, and so as to connect the first radio module selectively to the internal antenna or to the external connector.

9. The electrical equipment according to claim 8, wherein the switch device comprises a first double-throw switch and a second double-throw switch, the first double-throw switch having a first input (E1) connected to an output (S2) of the first radio module and a second input connected to an output of the second radio module via the RF link, and the second double-throw switch having an input connected to an output of the first double-throw switch, a first output connected to the internal antenna, and a second output connected to the external connector.

10. The electrical equipment according to claim 1, wherein a test frequency of the test signal is included in a frequency band in which the first radio module operates.

11. The electrical equipment according to claim 1, wherein the test signal is encoded so as to avoid an interfering signal at the test frequency disturbing the detector device.

12. The electrical equipment according to claim 1, wherein the first radio module is a cellular radio module and wherein the second radio module is an ISM radio module.

13. The electrical equipment according to claim 1, the electrical equipment being a meter.

14. The electrical equipment according to claim 1, the electrical equipment being a gateway.

15. A method of detecting and connecting the external antenna, the method being performed in electrical equipment according to claim 1 and comprising the steps of:

controlling the second radio module so that it generates and transmits the test signal over the external connector via the RF link;

acquiring the detection signal;

deducing from the detection signal whether or not the external antenna is connected to the external connector;

if the external antenna is connected to the external connector, connecting the first radio module to the connector; or else connecting the first radio module to the internal antenna.

16. A computer program including instructions for causing the electrical equipment according to claim 1 to execute a method of detecting and connecting the external antenna, the method comprising the steps of:

controlling the second radio module so that it generates and transmits the test signal over the external connector via the RF link;

acquiring the detection signal;

deducing from the detection signal whether or not the external antenna is connected to the external connector;

if the external antenna is connected to the external connector, connecting the first radio module to the connector; or else connecting the first radio module to the internal antenna.

17. A computer readable storage medium having stored thereon the computer program according to claim 16.

* * * * *